United States Patent [19]

Hansen

[11] 4,227,249

[45] Oct. 7, 1980

[54] INJECTED CODED REFERENCE FOR ADAPTIVE ARRAY SYSTEMS

[75] Inventor: Peder M. Hansen, San Diego, Calif.

[73] Assignee: The United States of America as represented by the Secretary of the Navy, Washington, D.C.

[21] Appl. No.: 713,006

[22] Filed: Aug. 9, 1976

[51] Int. Cl.[3] ..... H04K 1/02

[52] U.S. Cl. ..... 375/34

[58] Field of Search ..... 325/41, 42, 65, 44, 325/2, 4; 179/15 AP, 15 BP; 375/2, 11, 12, 14, 25, 34, 60, 115

[56] References Cited

U.S. PATENT DOCUMENTS

| | | | |
|---|---|---|---|
| 3,500,207 | 3/1970 | Ruthroff | 325/60 |
| 3,614,623 | 10/1971 | McAuliffe | 325/65 |
| 3,737,584 | 6/1973 | Kaneko | 179/15 BP |
| 3,864,635 | 2/1975 | Ewanus | 325/65 |
| 3,878,468 | 4/1975 | Falconer | 325/42 |
| 3,914,691 | 10/1975 | Meadors | 325/42 |
| 3,978,406 | 8/1976 | Matsumoto | 325/41 |

*Primary Examiner*—Benedict V. Safourek
*Assistant Examiner*—Michael A. Masinick
*Attorney, Agent, or Firm*—Richard S. Sciascia; George J. Rubens; Thomas M. Phillips

[57] ABSTRACT

A coded signal is added in the transmitting channel of a communications system to provide, at the receiver site, an adaptive processor with a reference signal for adaption. At the receiver site, the reference signal is removed to provide an error signal which is fed to the adaptive array processor. The error signal is also fed directly to the communications receiver without further processing.

5 Claims, 4 Drawing Figures

(WITHOUT REFERENCE)

(WITH REFERENCE)

INJECTED CODED REFERENCE FOR ADAPTIVE ARRAY SYSTEMS

BACKGROUND OF THE INVENTION

The present invention relates to communications systems and more particularly to communications systems which have adaptive signal processing. One established method of providing a communication system adaptive signal processing system with a reference signal is to transmit a pseudo random sequence with the information modulated on top of the sequence. This approach suffers from the disadvantage of requiring an entirely new modem for each application. Also for any given existing system, this approach would require extensive equipment changes. The processing gain in the reference generation loop is given by the ratio of the total bandwidth to the information bandwidth. This processing gain would be severely limited for existing systems because this modulation bandwidth (information rate) is a large percentage of the frequency assignment. In situations where jammers are used as, for example, in military application, a pilot tone could not be used as the reference signal since a jammer could also generate the same reference signal.

SUMMARY OF THE INVENTION

The present invention provides a means and method of providing to an existing communications system a reference signal that can be used to provide an adaptive processor (adaptive array or adaptive filter) with a reference signal for adaption. A source of coded reference signal filtered to match the bandpass of the communication system is added to the data signal being transmitted. At the receiver site the received signal including both the coded reference signal and the information signal is processed to provide a reference signal which is combined with the received signal to remove the coded reference signal from the received signal. The resultant signal is the error signal which is fed back to the adaptive array processor as well as to the communications receiver. In this manner an already existing communications system can be provided with the reference signal with a minimum of equipment changes.

An object of the invention is providing complete adaptive signal processing capability to any existing communications system with a minimum of hardware change.

Another object of the invention is the provision of the capability of adaptive signal processing by the use of an injected coded reference signal which makes it unavailable to a jammer.

A further object of the invention is the modification of a communications system to use an injected coded reference signal for an adaptive array processor which can maintain their original performance with respect to netting considerations, and propagation effects while providing increased performance due to antenna gain for the case of no interference (jammers) while providing significant protection against interference (jammers).

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
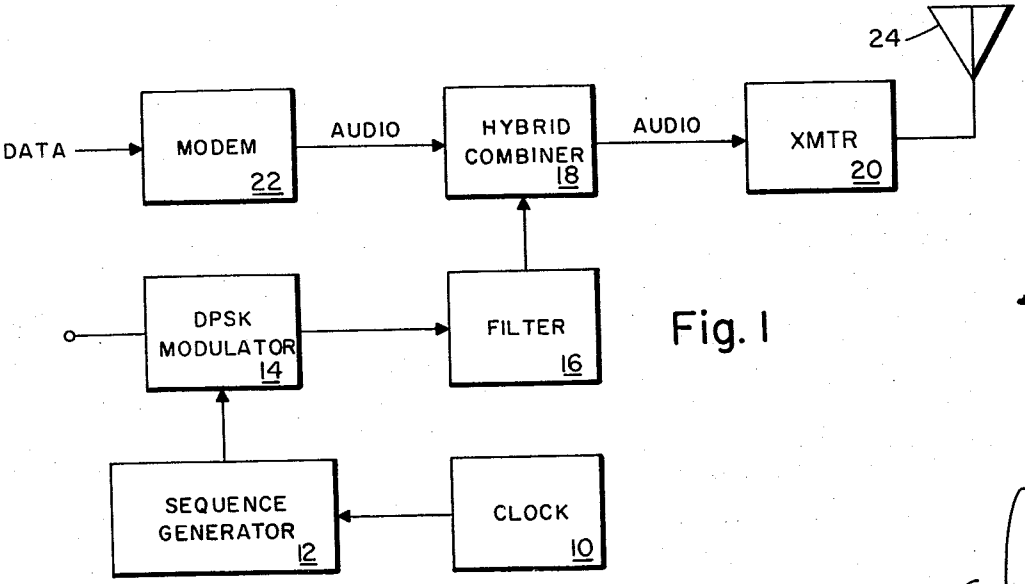
FIG. 1 is a block diagram of the transmitting system.

Referring now to FIG. 1 wherein there is shown a coded signal being generated by feeding the output of a clock source 10 to a sequence generator 12 to provide a pseudo noise sequence for differential phase shift key modulating a carrier in modulator 14. The output of modulator 14 is filtered by means of filter 16 to match the original bandpass of the system and is fed to hybrid combiner or summing circuit 18 for adding the reference signal with the data signal in the audio channel of the transmitter system. The transmitter portion of the communication system functions in the normal manner where data is fed to a modem 22 which provides the audio output to a radio transmitter 20 for transmission over a transmitting antenna 24.

The reference signal generated and combined in FIG. 1 is a pseudo noise sequence (DPSK) modulated on a carrier and filtered to match the original bandpass of the system. The reference signal is also shown as being added to the modulations in the audio stage but the signal could be added in the IF or RF stages. An important feature of the invention is that the information and reference portions of the transmitted signal are completely independent of each other.

Figure 2A:
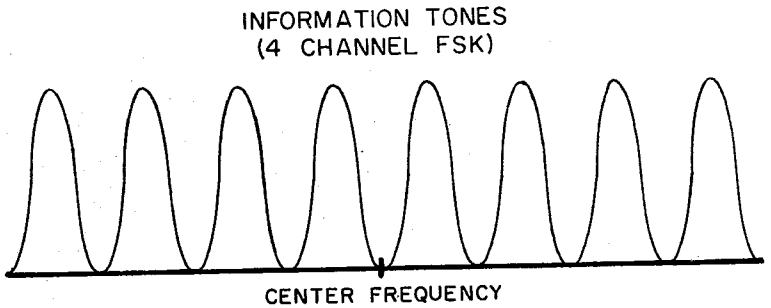
FIG. 2*a* and 2*b* show waveforms of a 4 channel FSK modulated signal without reference signal and with a DPSK reference signal added.
Figure 2B:
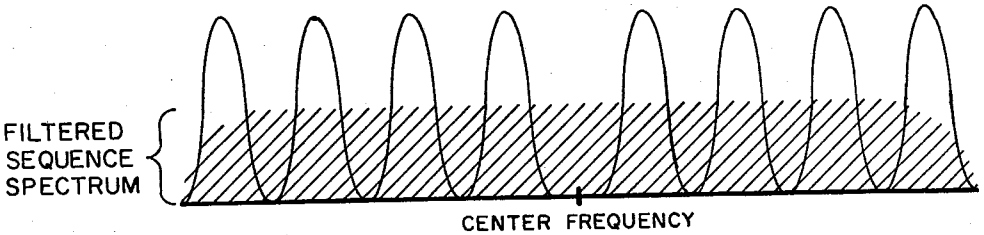

FIG. 2 shows the transmitted spectrum where the center frequency corresponds to the RF channel being used. FIG. 2*a* shows the spectrum of a 4 channel FSK digital data transmission in the normal manner without the injected reference signal. In accordance with the teaching of the invention the reference signal is added to the signal whose spectrum is shown in FIG. 2*a* and appears as the filtered sequence spectrum shown in FIG. 2*b*. The total transmitted signal contains both spectra illustrated in FIG. 2*b*.

Figure 3:
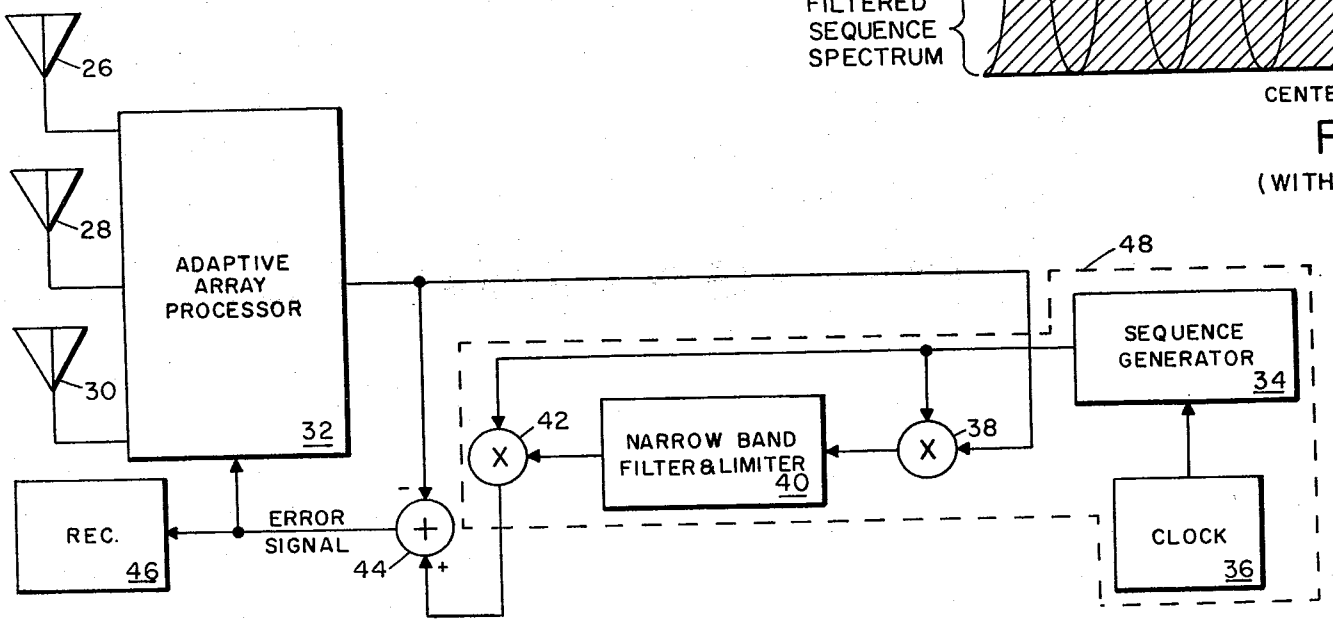
FIG. 3 shows in block diagram form the receiving portion of the communications system implementing the invention.

Referring now to FIG. 3 where there is shown the receiving portion of the communications system having receiving antennas 26, 28 and 30 which feed into an adaptive array processor 32. A specific adaptive array processor is not shown, however, it may be of the type shown and described by Robert L. Riegler and Ralph T. Compton Jr, Proceedings of the IEEE, V 61, No. 6, June 1973, pp 748 to 758.

A coded signal similar to the one added to the transmitted signal in the transmitter section shown in FIG. 1 is generated by means of feeding the pulses from clock source 36 to sequence generator 34 clocks 10 and 34 are typical time standards used in communication and synchronized in the standard manner used in special spectrum communication. Sequence generators 12 and 34 generates a pseudorandom binary sequence as described in Modern Dictionary of Electronics, Howard W. Sam and Co., Inc. (1922). Techniques for generation of such sequences are well known. The output signal from adaptive array processor 32 is combined with the coded signal from sequence generator 34 in multiplier circuit 38. The output signal from multiplier 38 is fed to a narrow band filter and limiter 40 by providing a signal within the bandpass of the communication system. The output from band filter and limiter 40 is combined with the output of sequence generator 34 in multiplier circuit 42 which provides the desired reference signal with a positive polarity. The output signal from adaptive array processor 32 with a negative polarity signal is combined with the reference signal in adding circuit 44, the output of which is the error signal that is fed back to adaptive array processor 32. An important feature of the invention is the manner in which the processed reference signal and the output signal adaptive from the array processor are combined to eliminate the reference signal from the received signal which permits the error signal (containing the information portion of the transmitted signal) to be fed directly to receiver 46.

In the reference signal recovery loop 48, in the example shown, the processing consists of analog correlation. The processing gain available is approximately equal to the ratio of the input sequence bandwidth to the output filter bandwidth. In a direct spread spectrum system the output filter 40 bandwidth would be limited to the information bandwidth. However, in the embodiment shown, the correlator output filter 40 can be arbitrarily narrow. This then provides for large processing gains. This means that the coded reference signal could be at a low level with respect to the modulation information. This would then permit the coded reference signal to be transmitted at a low enough level so that it would not interfere with communications to receiving stations not having the adaptive processor.

Since an important feature of the invention is that the reference signal and the information signal are independent, the portion of transmitted power allotted to each part can be defined as follows $P_T = P_I + P_R$ where $P_T$ = total transmitted power (instant). $P_I$ = power and information modulation signal, and $P_R$ = power and reference signal. The ratio of $P_I$ to $P_R$ can be varied while keeping $P_T$ constant as follows, $P_I = QP_T$ and $P_R$ $(1-Q)P_T$ where Q varies between 0 and 1. As the value of Q is varied the optimum solution for the array weights (that minimize the mean square error) changes by constant value related to Q and consequently the array pattern remains unchanged and the output signal to interference or jammer ratio remains unchanged.

Obviously many modifications and variation of the present invention are possible in the light of the above teachings. It is therefore to be understood that within the scope of the appended claims the invention may be practiced otherwise than as specifically described.

What is claimed is:

1. In a communication system having adaptive signal processing the improvement comprising:

(a) first means for generating a coded reference signal filtered to match the bandpass of the system;

(b) second means for generating a signal representing information to be transmitted by said communication system;

(c) third means for combining said coded reference signal with said information signal;

(d) transmitter means for transmitting said combined signals;

(e) a receiving system for receiving the signal transmitted by said transmitter means, said receiving system including a reference signal recovery loop for recovering said reference signal that can be combined with the output signal from an adaptive array to form the error signal for adaptive signal processing.

2. The system of claim 1 wherein said source of coded reference signal is a pseudo-noise sequence generator.

3. The system of claim 1 wherein said reference signal recovery loop includes means for generating a signal that closely approximates the transmitted reference portion of the transmitted signal.

4. The system of claim 1 wherein said reference signal recovery loop comprises:

(a) means for generating a signal closely approximating the transmitted coded reference signal;

(b) first multiplier circuit means coupled to said signal generating means and adapted to receive the output of an adaptive array processor and providing an output;

(c) second multiplier circuit means having a first input coupled to said signal generating means, a second input connected in circuit with filter and limiter circuit means to the output of said first multiplier circuit means and providing a positive output signal;

(d) summing circuit means adapted to receive the output of said processor and coupled to said second multiplier circuit means for removing the reference signal from the processor output signal to provide the error signal.

5. A method of providing an existing communication system having an existing signal with a coded reference signal that can be used by an adaptive signal processor the steps of:

(a) adding a coded reference signal to the existing signal (b) transmitting said combined signals so that both signals are transmitted in the same bandwidth;

(c) generating an approximation of the transmitted coded reference signal and;

(d) generating an error signal for use by an adaptive array processor by substracting said approximation of the transmitted coded reference signal from said transmitted signal.

* * * * *